US006352047B1

(12) United States Patent
Bogniard

(10) Patent No.: US 6,352,047 B1
(45) Date of Patent: Mar. 5, 2002

(54) RAIL MOUNTED CHAIR ASSEMBLY FOR BOATS

(76) Inventor: Jeffrey R. Bogniard, 465 N. Turner Rd., Austintown, OH (US) 44515

( * ) Notice: Subject to any disclaimer, the term of this patent is extended or adjusted under 35 U.S.C. 154(b) by 0 days.

(21) Appl. No.: 09/610,462

(22) Filed: Jul. 5, 2000

Related U.S. Application Data

(60) Provisional application No. 60/142,748, filed on Jul. 8, 1999.

(51) Int. Cl.[7] ..... B63B 17/00
(52) U.S. Cl. ..... 114/363
(58) Field of Search ..... 114/363, 61.24; 248/299.1, 424, 429, 430

(56) References Cited

U.S. PATENT DOCUMENTS 2,643,628 A * 6/1953 Sveinsson
2,903,047 A * 9/1959 Funyak
4,352,218 A 10/1982 Lundberg ..... 114/363
5,669,324 A 9/1997 Muir, III ..... 114/194
5,709,154 A 1/1998 Schott ..... 105/29.1
5,787,837 A 8/1998 Vavolotis ..... 114/363
5,884,575 A * 3/1999 Talasimov

* cited by examiner

*Primary Examiner*—Sherman Basinger
(74) *Attorney, Agent, or Firm*—Sand & Sebolt

(57) ABSTRACT

A movable chair assembly for a boat is suspended on the stern rails of the boat. The chair is movably mounted to the stern rail so that it may rotate from one side of the boat to the other allowing a person to move about the cockpit of a boat without the use of his legs. The chair assembly includes a braking assembly that allows the position of the chair to be locked.

20 Claims, 6 Drawing Sheets

RAIL MOUNTED CHAIR ASSEMBLY FOR BOATS

CROSS-REFERENCE TO RELATED APPLICATION

The present application claims priority from United States Provisional Patent Application Serial No. 60/142,748 filed Jul. 8, 1999, entitled Rail Mounted Chair Assembly for Boats, the disclosures of which are incorporated herein by reference.

BACKGROUND OF THE INVENTION

1. Technical Field

The present invention generally relates to devices for moving around a water craft and, more particularly, to a seat or chair movably mounted to the rear of a sailboat to allow an operator having a physical disability to move easily from port to starboard and back again to port while in full control of the sailboat. Specifically, the present invention relates to a chair for a sailboat that is suspended by the rail system on the back of a sailboat with the suspension arrangement allowing the chair to move back and forth between the port and starboard sides of the sailboat.

2. Background Information

Sailing is a recreational activity enjoyed by many throughout the world. As is well known to those who sail throughout the world, a sailboat tilts or "heels" to the leeward direction. The operator of the boat typically desires to be on the windward or high side of the boat in order to best control the boat and have the clearest field of vision while controlling the boat.

Unfortunately, it is somewhat difficult for people to move about in sailboats. There are typically numerous sheets, lines, and other obstacles over and through which the person must maneuver. While it is difficult for a fully capable person to quickly move back and forth while maintaining full control of the sailboat, the task is especially difficult for an operator with a physical disability.

It is thus desired in the art to provide a seat for a sailboat that allows an operator with a physical disability to quickly and easily move from the port to the starboard side and from the Starboard to the port side of the boat. It is also desired to position the chair in locations where the operator may maintain complete control over the boat throughout the entire range of motion of the chair.

Other movable chairs for boats have been developed and are known in the art. For instance, U.S. Pat. No. 4,352,218 discloses a mobile chair for use by handicapped persons for a boat. This chair includes a seat and a footrest that are slidable along guide rails mounted to the deck of the boat. The chair is also rotatable about a trunnion through at least 180°. Although this seat is useful for allowing a person to move back and forth in a boat, the chair requires significant modification to the deck of the boat and would likely lead to tangles with the equipment in the boat.

Another device is disclosed in U.S. Pat. No. 5,669,324. This device is an automatically-leveling chair that is mounted on a U-shaped frame. The chair is supported on a plurality of rollers on the U-shaped frame so that the chair remains level with respect to the horizon while the boat heals one way or the other. Although this chair is mobile, it does not allow the operator to move from the starboard side of the boat to the port side of the boat.

One further device is disclosed in U.S. Pat. No. 5,787,837. This device is to be used on a catamaran having a trampoline-style deck. The device disclosed in this patent allows the operator to slide back and forth from one side of the boat to the other but still requires significant effort by the operator.

SUMMARY OF THE INVENTION

In view of the foregoing, it is an objective of the present invention to provide a movable chair for a boat.

Another objective of the present invention is to provide a movable chair for a sailboat that allows the user of the chair to move from the starboard side to the port side and from the port side to the starboard side of the sailboat while maintaining full control of the sailboat.

Another objective of the present invention is to provide a movable chair for a boat that is suspended above the deck of the boat so as to not interfere with the boat's equipment during use.

Another objective of the present invention is to provide a movable chair that may be used by an operator with a physical disability.

Another objective of the present invention is to provide a movable chair for a sailboat that is mounted to the stern rails of the sailboat.

Another objective of the present invention is to provide a movable chair that may be used with a wide variety of boats.

Another objective of the present invention is to provide a movable chair for a boat that includes a brake system that holds the position of the chair when the user wants the chair to stay in position.

Another objective of the present invention is to provide a movable chair for a boat that is stable while the boat moves through waves and heels at different angles.

Another objective of the present invention is to provide a movable chair for a boat that allows the user of the chair to move longitudinally along either the port or starboard side of the boat in order to select the most advantageous location to operate the boat at the given conditions.

These and other objectives and advantages of the invention are achieved by the combination of a chair assembly and a boat wherein the boat includes a hull having an upper surface. The boat further includes a first rail disposed above the hull. The chair assembly includes a seat adapted to hold the user of the chair assembly. The chair assembly is at least partially carried by the rail with the seat suspended above the hull.

BRIEF DESCRIPTION OF THE DRAWINGS

The preferred embodiments of the invention, illustrative of the best mode in which applicant has contemplated applying the principles of the invention, are set forth in the following description and are shown in the drawings and are particularly and distinctly pointed out and set forth in the appended claims.

Similar numbers refer to similar parts throughout the specification.

DESCRIPTION OF THE PREFERRED EMBODIMENTS

Figure 1:
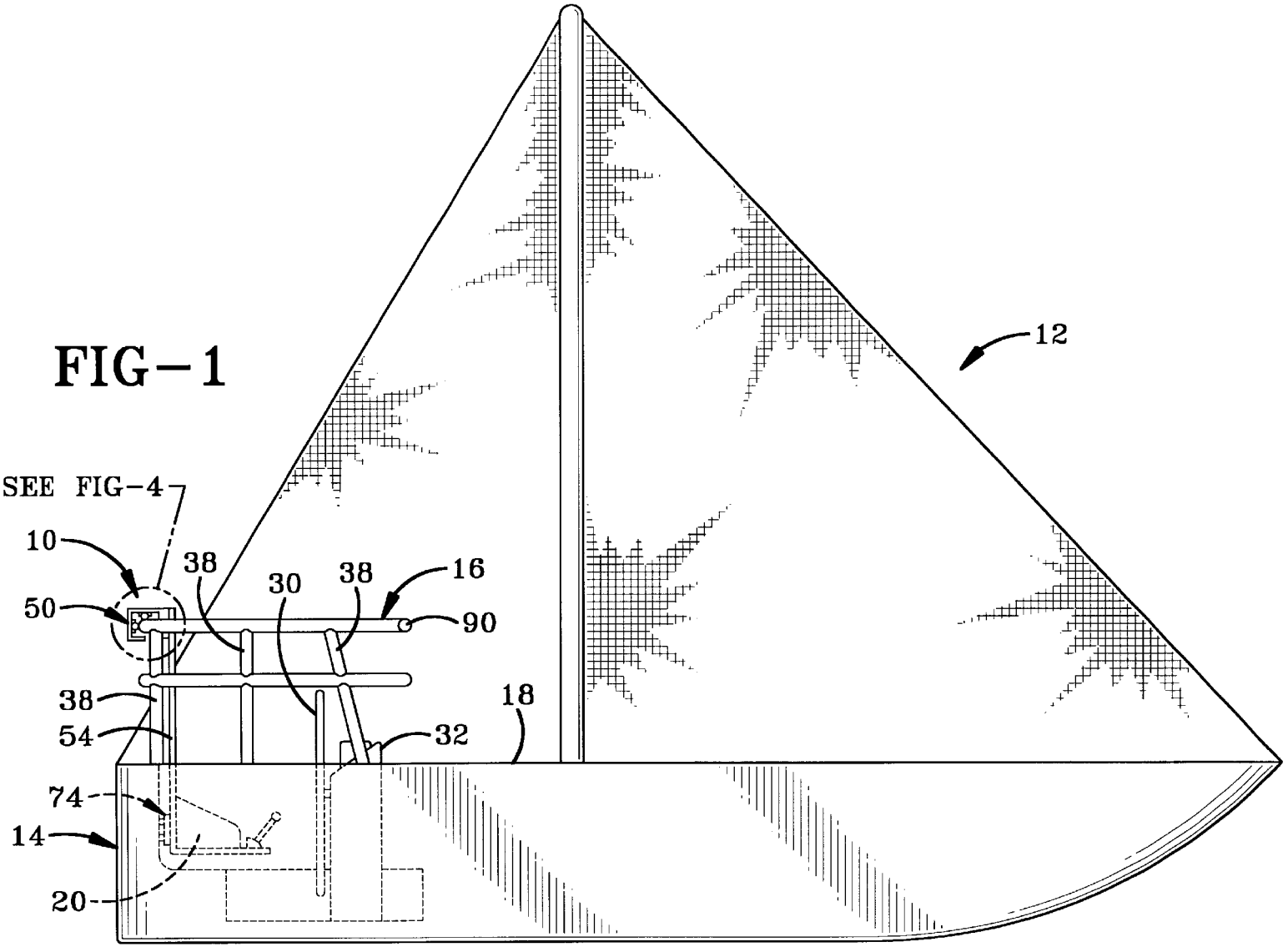
FIG. 1 is a side elevational view of a boat incorporating the movable chair assembly of the present invention.
Figure 2:
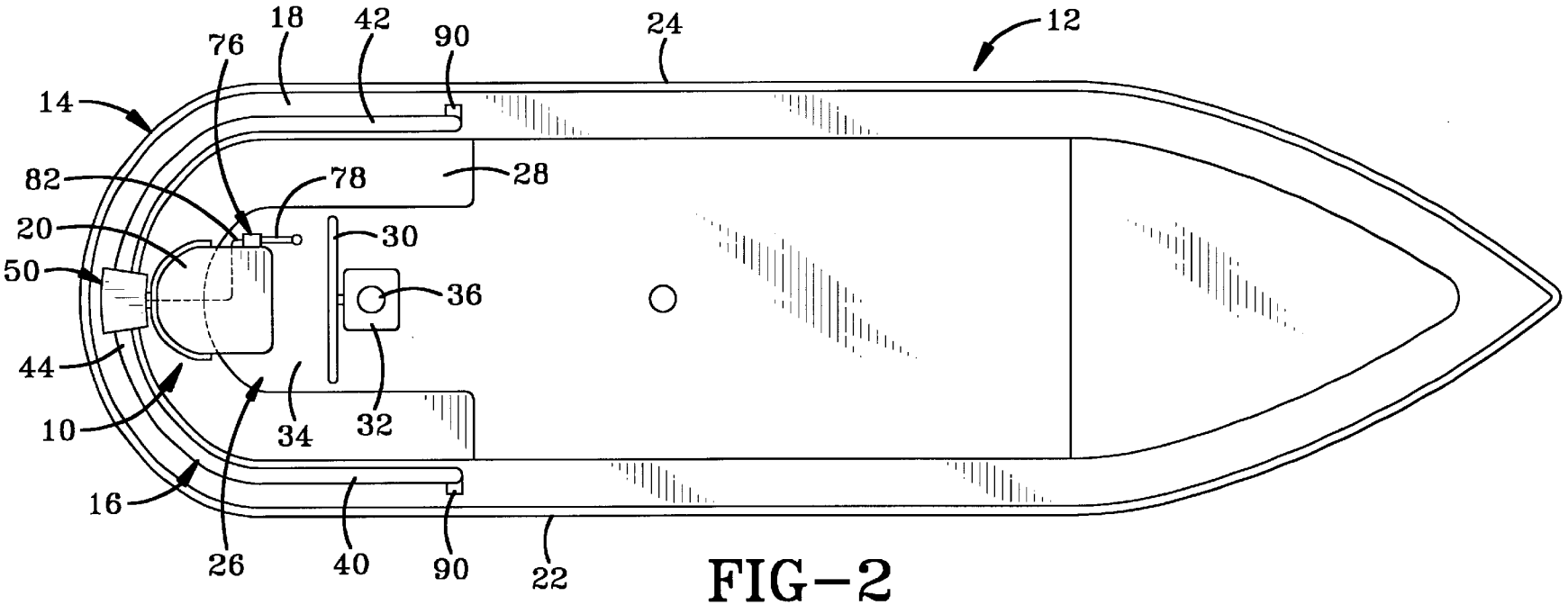
FIG. 2 is a top plan view of the boat of FIG. 1.

The movable chair assembly of the present invention as indicated generally by the numeral 10 in the accompanying drawings. Chair assembly 10 is designed to mount on and work with a boat 12 that includes a hull 14. Chair assembly 10 mounts on at least one rail 16 that extends about a portion of the perimeter of hull 14 and is disposed a distance above the upper surface 18 of hull 14. Chair assembly 10 is designed to move along substantially the entire length of rail 16 thus allowing the seat 20 of chair assembly 10 to be positioned on either the starboard side 22 of boat 12 or the port side 24 of boat 12. Chair assembly 10 is movable along rail 16 in a manner that prevents chair assembly 10 from becoming tangled in the equipment of the boat and without requiring modification to the deck of boat 12.

Figure 6:
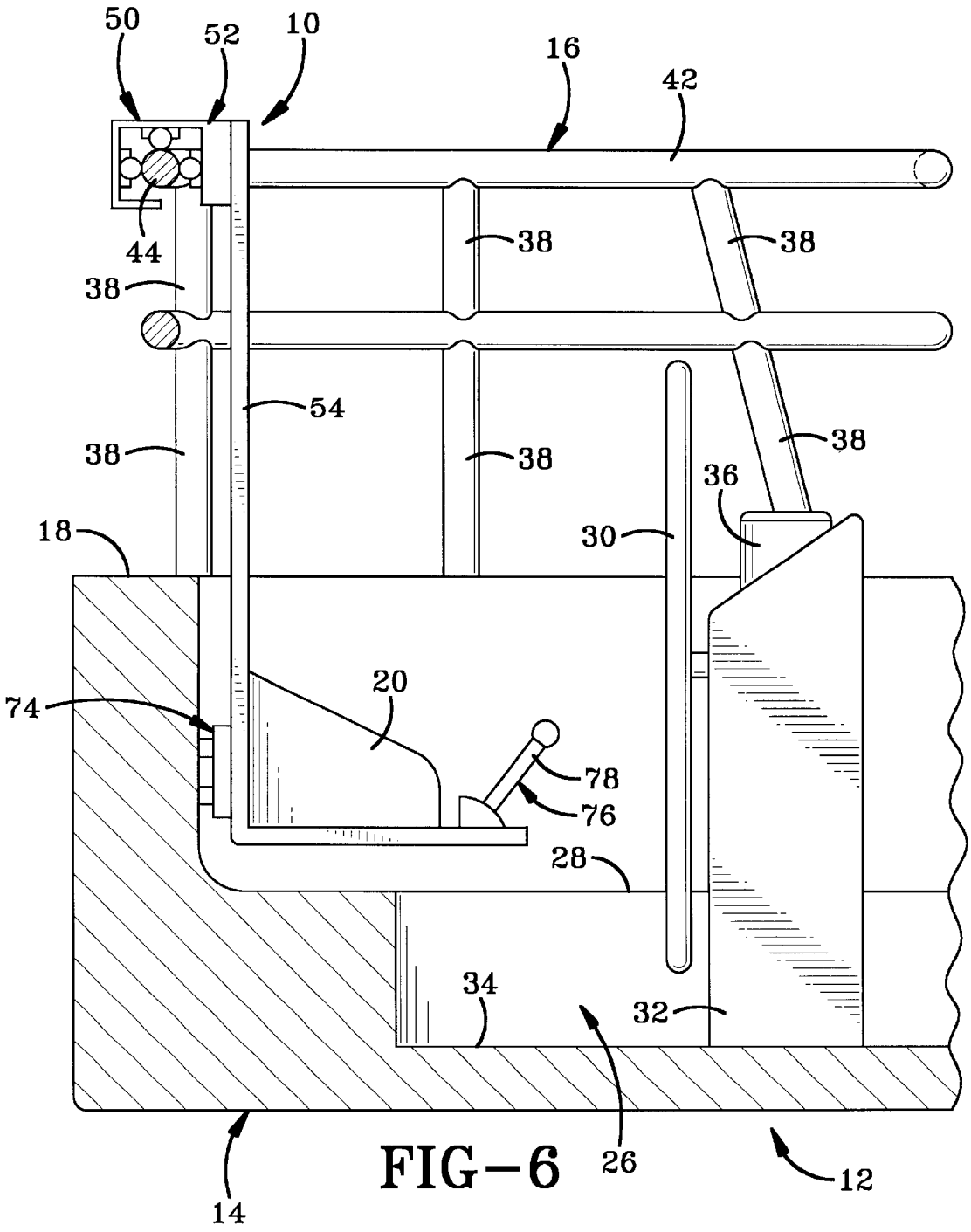
FIG. 6 is an enlarged side elevational view, with portions in section, of the movable chair assembly.

In the embodiment of the invention depicted in the drawings, boat 12 includes a sunken cockpit 26 surrounded by a bench seat 28. As shown in FIG. 6, the wheel 30 that controls the rudder (not shown) of boat 12 typically is supported by a pedestal 32 that extends upwardly from the bottom surface 34 of cockpit 26. Pedestal 32 may also support instruments 36 such as a compass. It is thus desired, and an objective of the present invention, to position chair assembly 10 so that it is movable around wheel 30 above cockpit 26 and bench seats 28. It is shown in the drawings that seat 20 floats above the upper surface of bench seats 28 and is movable around wheel 30. This configuration allows the user of chair assembly 10 access to wheel 30 at all times. This configuration also prevents seat 20 or chair assembly 10 from becoming tangled in the sheets or lines that may be present in the bottom of cockpit 26 or laying on bench seat 28.

Figure 3:
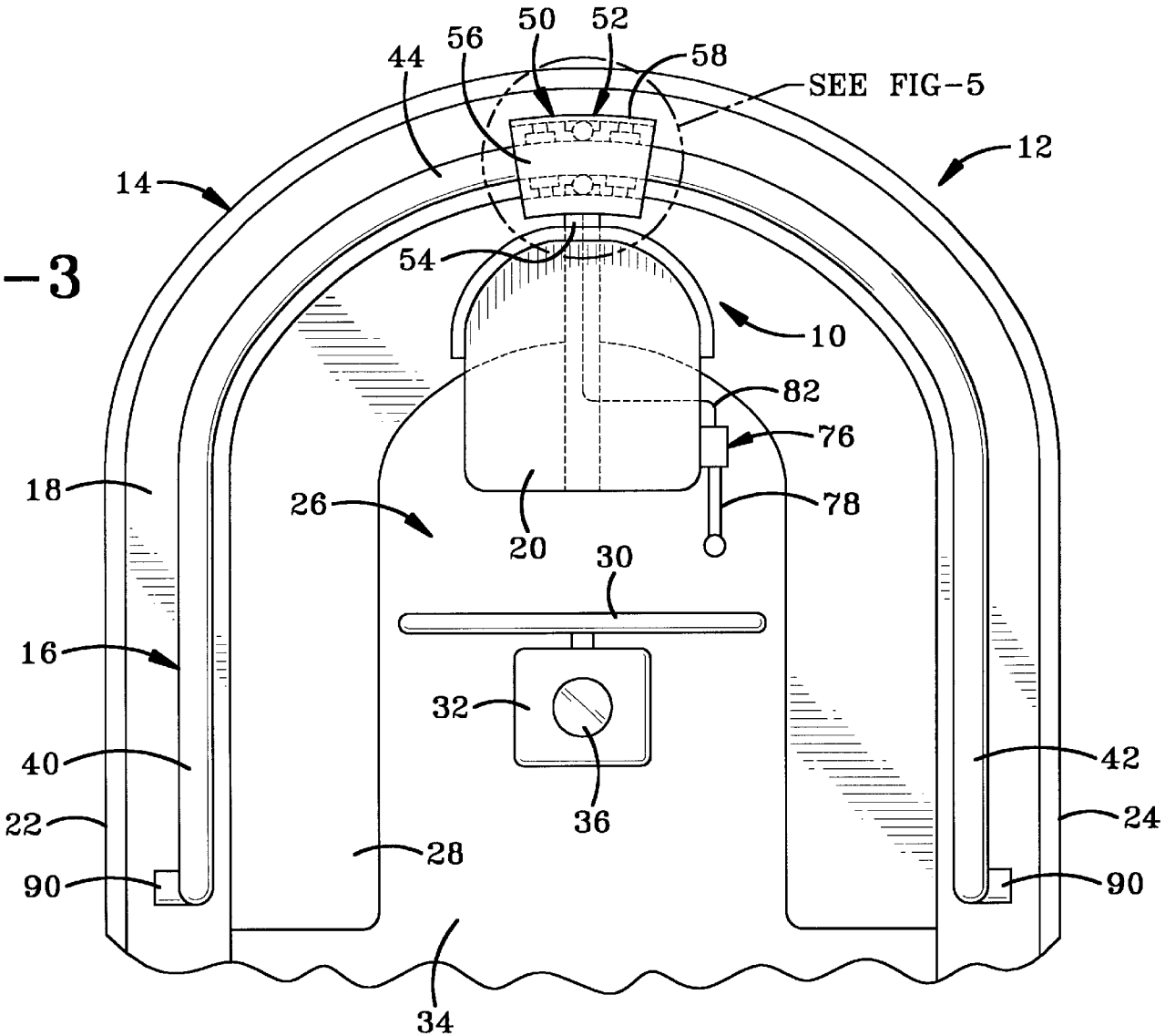
FIG. 3 is an enlarged top plan view of the rear portion of the boat of FIG. 2.

Rail 16 is supported above hull 14 by a plurality of vertical supports 38. Supports 38 are firmly anchored to hull 14 and are capable of supporting the weight of the operator in chair assembly 10. Vertical supports 38 may extend directly between deck 18 and rail 16 or may be combined with a plurality of other reinforcing supports known in the art to provide strength to chair assembly 10. Rail 16 includes two substantially straight, longitudinally—extending side portions 40 and 42 that are connected by a curved stern portion 44 that connects with each side portion in a smooth curve as is perhaps best depicted in FIG. 3. Portions 40, 42, and 44 substantially follow the perimeter of deck 18. Side portions 40 and 42 may extend up along cockpit 26 so that seat 20 may be moved in front of wheel 30 if desired by the operator.

Chair assembly 10 includes a roller housing 50 that mounts seat 20 to rail 16. Roller housing 50 includes a frame 52 having a base 54, a top plate 56 connected to base 54, a rear plate 58 extending down from the end of top plate 56, and a bottom plate 60 extending back toward base 54 from the bottom of rear plate 58. Base 54, top plate 56, rear plate 58, and bottom plate 60 cooperate to substantially surround the portion of rail 16 where roller housing 50 is located. Roller housing 50 includes three rollers 62, 64, and 66 that rotatably mount roller housing 50 to rail 16. Roller 62 is rotatably mounted on rear plate 58 by a suitable mount 68. Roller 64 is mounted to top plate 56 by a suitable mount 70 while roller 66 is mounted directly to base 54 by a suitable mount 72. Rollers 62, 64, and 66 thus prevent roller housing 50 from moving off of rail 16 while it slides along rail 16. Bottom plate 60 prevents roller housing 50 from moving off of rail 16. In other embodiments of the present invention a roller may be disposed between rail 16 and bottom plate 60. In other embodiments of the present invention, a sleeve having an inner surface that substantially matches the outer surface of rail 16 may be used in place of roller 62, 64, and 66.

Base 54 extends down and connects with seat 20 to provide substantially rigid support between seat 20 and roller housing 50. A second roller assembly 74 is disposed between base 54 and hull 14 to prevent seat 20 from rotating, about rail 16. Roller assembly 74 and roller housing 50 combine to support seat 20 in a stable manner above bench seat 28 while allowing it to rotate along rail 16.

Figure 5:
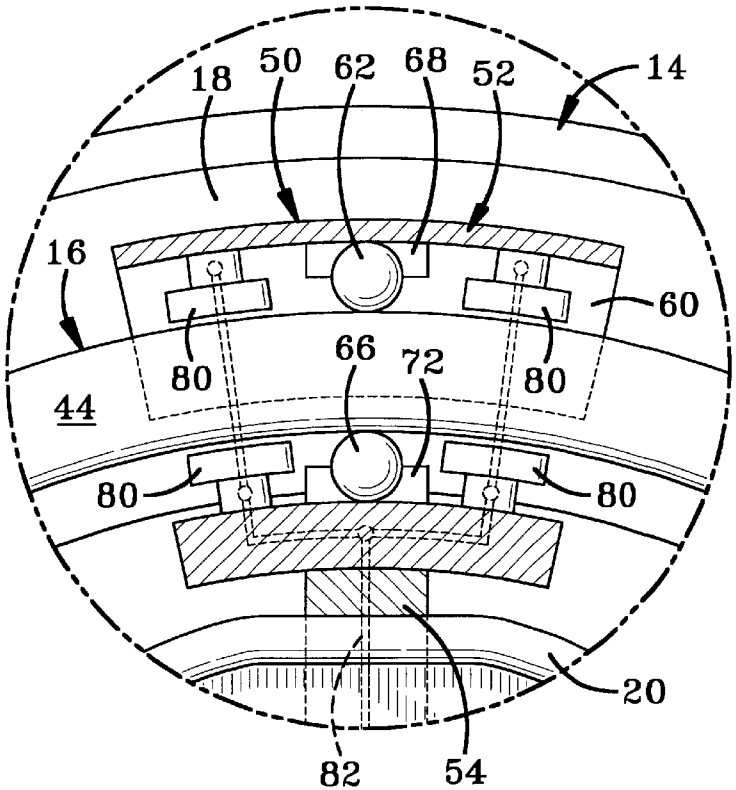
FIG. 5 is an enlarged detailed view of the encircled portion of FIG. 3.
Figure 4:
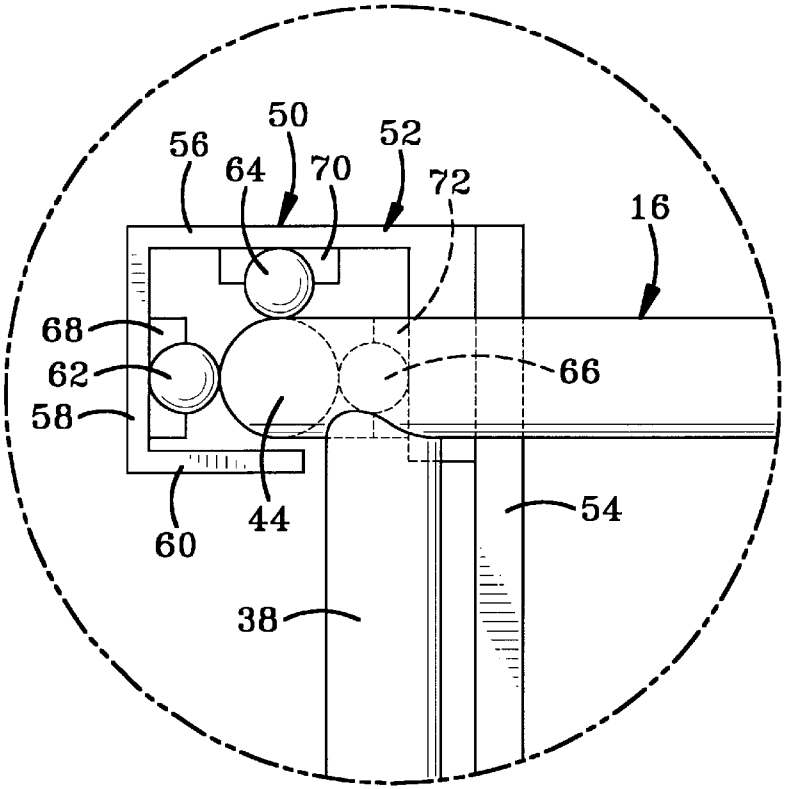
FIG. 4 is an enlarged detailed view of the encircled portion of FIG. 1.

Chair assembly 10 further includes a brake assembly 76 that includes a brake handle 78 and at least one brake pad 80. Brake assembly 76 allows the user of chair assembly 10 to selectively lock and unlock the position of roller housing 50 with respect to rail 16. In some embodiments, roller housing 50 may be locked to rail 16 when brake handle 78 is released such that seat 20 and roller housing 50 are normally locked to rail 16. In other embodiments, seat 20 and roller housing 50 are normally unlocked from rail 16 and are only locked in position when brake handle 78 is activated. In the embodiment of the invention depicted in FIG. 5, four brake pads 80 are disposed on either side of rollers 62, 64, and 66 and on either side of rail 16. Brake pads 80 are connected by a brake cable 82 to brake handle 78 such that each brake pad 80 may be moved into and out of engagement with rail 16 by movement of cable 82.

It may now be understood that seat 20 may be slid along rail 16 to any position along rail 16 between its ends. Safety flanges 90 (FIG. 3) may be positioned at the ends of rail 16 to prevent roller housing 50 from falling off of the end of rail 16. In use, user or operator sits on seat 20 and controls the movement of roller housing 50 and seat 20 by pulling himself with his arms along rail 16. Brake assembly 76 may then be manipulated as required to lock and unlock the position of roller housing 50 with respect to rail 16. Chair assembly 10 thus allows the operator or user to move about the stern of boat 12 without the use of his legs. Chair assembly 10 is thus ideal for use by a handicapped person who is normally confined to a wheelchair.

Figure 7:
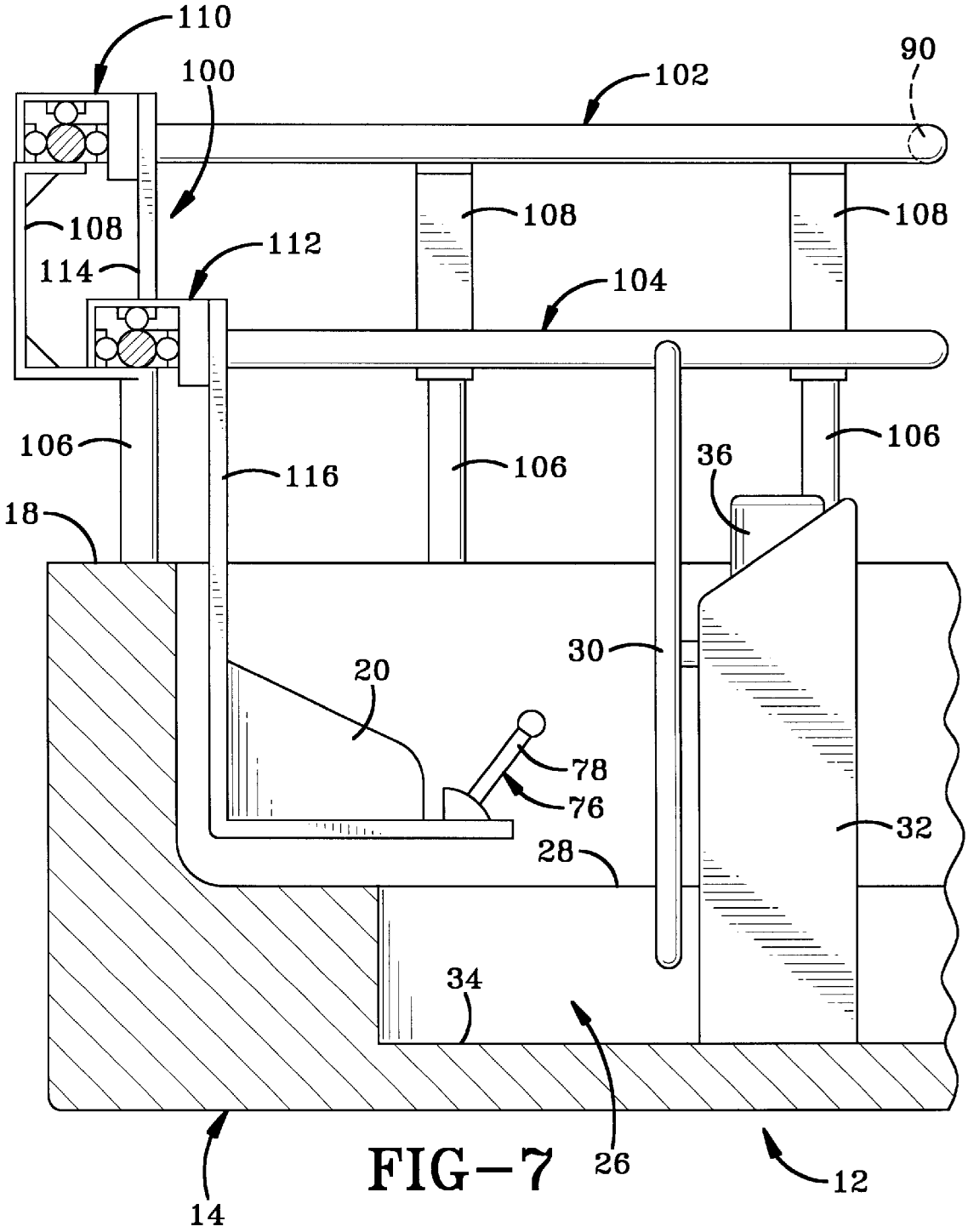
FIG. 7 is a view similar to FIG. 6 showing an alternative version of the present invention.

An alternative embodiment of the chair assembly of the present invention is indicated generally by the numeral 100 in FIG. 7. Chair assembly 100 is used with many of the same elements as chair assembly 10 and the same numbers are used to refer to the same elements in both embodiments. Chair assembly 100 includes seat 20 and brake assembly 76 as described above. The main difference between chair assembly 100 and chair assembly 10 is that chair assembly 100 does not rotatably engage any portion of hull 14. Chair assembly 100 instead slides on an upper rail 102 and a lower rail 104. Rails 102 and 104 are supported from hull 14 by a plurality of vertical supports 106 that extend between hull 14 and lower rail 104 and a plurality of clips 108 that extend between lower rail 104 and upper rail 102 in a manner that allows a pair of roller housings 110 and 112 to slidably engage rails 102 and 104, respectively. Roller housings 110 and 112 are substantially the same as roller housing 50 as described above with respect to chair assembly 10. Housings 110 and 112 are connected by the base extension 114 with housing 112 being connected to seat 20 by a base 116. Housings 110 and 112 are prevented from moving upwardly with respect to rails 102 and 104 either by the weight of the operator sitting in chair 20 or by the positioning of the rollers present in roller housings 110 and 112.

Chair assembly 100 may thus be used on boats that have irregularly shaped cockpits 26 because seat 20 and base 116 do not require any rolling connection with hull 14. Rails 102 and 104 may be placed at any desired location as long as cockpit 26 provides sufficient room for seat 20.

Accordingly, the improved rail mounted assembly is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the rail mounted assembly is constructed and used, the characteristics of the construction, and the advantageous new and useful results obtained; the new and useful structures, devices, elements, arrangements, parts, and combinations are set forth in the appended claims.

I claim:

1. A chair assembly and boat in combination:

the boat including a hull having an upper surface;

the boat further including a first rail disposed above the hull;

the chair assembly including a seat adapted to hold the user of the chair assembly;

the chair assembly being at least partially carried by the rail with the seat suspended above the hull; and the seat of the chair assembly being suspended below the first rail.

2. The combination of claim 1, further comprising a second rail disposed above the hull; the chair assembly being at least partially carried by the second rail.

3. The combination of claim 2, wherein the first and second rails are substantially parallel.

4. The combination of claim 1, wherein the chair assembly is selectively slidable along the first rail.

5. The combination of claim 4, further comprising a brake system configured to selectively lock the position of the chair assembly with respect to the first rail.

6. The combination of claim 5, further comprising a hand lever; the hand lever movable between an unlocked position and a locked position; the locked position of the hand lever corresponding to the locked position of the chair assembly.

7. The combination of claim 6, further comprising a pair of brake pads disposed adjacent the first rail and a brake cable disposed between the brake pads and the hand lever; the brake pads being forced against the first rail by the cable when the hand lever is in the locked position.

8. The combination of claim 1, wherein the chair assembly includes a plurality of rollers engaging the first rail.

9. The combination of claim 8, wherein the chair assembly includes three rollers disposed about the first rail.

10. A chair assembly and boat in combination:

the boat including a hull having an upper surface;

the boat further including a first rail disposed above the hull;

the chair assembly including a seat adapted to hold the user of the chair assembly;

the chair assembly being at least partially carried by the rail with the seat suspended above the hull;

wherein a cockpit having a rearwall is defined by the hull; the chair assembly being at least partially supported by the rear wall of the cockpit.

11. The combination of claim 10, wherein the chair assembly includes a roller that engages the rear wall of the cockpit.

12. The combination of claim 1, wherein the hull includes a cockpit; the first rail extending at least partially around the cockpit.

13. The combination of claim 12, wherein the first rail includes a pair of substantially straight, longitudinally—extending side portions and a curved stern portion connecting the side portions.

14. The combination of claim 1, further comprising a plurality of vertical supports holding the first rail above the hull.

15. The combination of claim 1, wherein the chair assembly includes a base having an upper end and a lower end; the upper end of the base being connected to the first rail; and the lower end of the base being connected to the seat.

16. A chair assembly and boat in combination:

the boat including a hull having an upper surface;

the hull defining a cockpit having a seat portion and a support wall portion;

the boat further including a first rail disposed above the hull;

the chair assembly including a seat adapted to hold the user of the chair assembly;

the chair assembly being at least partially carried by the rail with the seat suspended above the seat portion of the cockpit; and the chair assembly engaging the support wall portion of the cockpit.

17. The combination of claim 16, wherein the chair assembly includes a roller that engages the support wall portion of the cockpit.

18. The combination of claim 17, wherein the chair assembly is slidingly mounted to the first rail.

19. A chair assembly and boat in combination:

the boat including a hull having an upper surface;

the hull defining a cockpit having a seat portion;

the boat further including first and second rails disposed above the hull;

the chair assembly including a seat adapted to hold the user of the chair assembly;

the chair assembly being carried by the first and second rails with the seat suspended above the seat portion of the cockpit; and the seat of the chair assembly being suspended below the first and second rails.

20. The combination of claim 19, wherein the chair assembly includes rollers engaging the first and second rails.

* * * * *